United States Patent [19]

Barbieri et al.

[11] 4,424,610

[45] Jan. 10, 1984

[54] OBJECT-SIMULATING BELT BUCKLE

[75] Inventors: John J. Barbieri, 756 E. Main St., East Aurora, N.Y. 14052; Ross C. Oar, Orchard Park, N.Y.

[73] Assignee: John J. Barbieri, East Aurora, N.Y.

[21] Appl. No.: 245,016

[22] Filed: Mar. 18, 1981

[51] Int. Cl.[3] ..... A44B 11/00

[52] U.S. Cl. ..... 24/163 K

[58] Field of Search ..... 24/163 K, 163; 46/232; 40/21 C

[56] References Cited

U.S. PATENT DOCUMENTS

| | | | |
|---|---|---|---|
| 3,081,998 | 3/1963 | Weiss | 46/232 X |
| 3,391,489 | 7/1968 | Lohr et al. | 46/232 |
| 3,882,617 | 5/1975 | Gagner | 40/21 C |
| 4,124,022 | 11/1978 | Gross | 46/232 |
| 4,260,087 | 4/1981 | Leaver | 24/163 K X |

FOREIGN PATENT DOCUMENTS

| | | | |
|---|---|---|---|
| 2020539 | 11/1979 | United Kingdom | 24/163 K |

*Primary Examiner*—Hugh R. Chamblee

*Attorney, Agent, or Firm*—Christel, Bean & Linihan

[57] ABSTRACT

A belt buckle comprising a body adapted to be connected to a belt for wearing on a user and having a structure which simulates a known object having a movable component, for example an automobile, bell or animal such as a bird. An element is movably connected to the body and located so as to be exposed to view when the buckle is worn on the user, and the element has a structure which simulates the movable component of the object, for example the automobile hood, bell striker or bird beak. An operator member is movably carried by the body and responsive to manual operation, and a motion transmission mechanism carried by the body and operatively connected to the element and to the operator member converts movement of the operator member in response to manual operation into movement of the element relative to the body. As a result, activity of the known object is simulated. The buckle further includes sound generating means carried by the body and operatively connected to the operator member for providing an audible sound output in response to movement of the operator member, the particular sound being selected to have some relation to the known object being simulated.

10 Claims, 7 Drawing Figures

OBJECT-SIMULATING BELT BUCKLE

BACKGROUND OF THE INVENTION

This invention relates to the art of belt buckles, and more particularly to a new and improved belt buckle for simulating the appearance and activity of a known object.

Belt buckles heretofore available have a wide variety of shapes and ornamentation. It would be highly desirable to provide a belt buckle having added features of amusement and novelty. More particularly, it would be highly desirable to provide a belt buckle for simulating the appearance and activity of a known object, the object being the type which has a movable component and emits a characteristic sound at least sometimes during its activity or operation.

SUMMARY OF THE INVENTION

It is, therefore, a primary object of this invention to provide a new and improved belt buckle for simulating the appearance and activity of a known object.

It is a more particular object of this invention to provide such a belt buckle which simulates both the appearance of the known object and the movements of a movable component of the object.

It is a further object of this invention to provide such a belt buckle which simulates the movements of the movable component of the object in response to manual operation by the wearer of the buckle.

It is a further object of this invention to provide such a belt buckle which generates a sound characteristic of the object being simulated in response to manual operation by the wearer of the buckle.

It is a further object of this invention to provide such an object-simulating belt buckle which is simple in construction, economical to manufacture and easy and effective in operation.

The present invention provides a belt buckle comprising a body adapted to be connected to a belt for wearing on a user and having a structure which simulates a known object having a movable component, for example an automobile, bell, or animal such as a bird. An element is movably carried by the body and located so as to be exposed to view when the belt buckle is worn on the user, and the element has a structure which simulates the movable component of the object, for example the automobile hood, the bell striker or the bird beak. An operator member is carried by the body in a manner permitting movement of the member in two directions relative to the body in response to manual operation. Motion transmission means carried by the body is operatively connected to the element and to the operator member for converting movement of the operator member into movement of the element in two directions relative to the body. As a result, activity of the known object is simulated by the belt buckle in response to manual operation thereof. The belt buckle further includes sound generating means carried by the body and operatively connected to the operator member for providing an audible sound output in response to movement of the operator member in at least one of the two directions. The particular sound generated is selected to have some relation to the known object being simulated.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
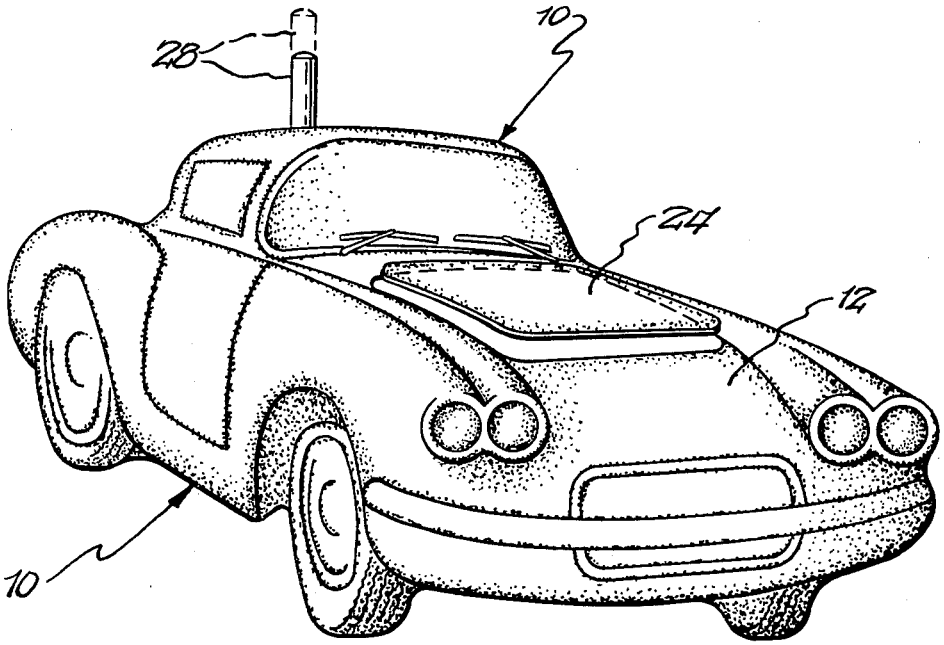
FIG. 1 is an elevational view of the front or exposed surface of a belt buckle according to the present invention.
Figure 2:
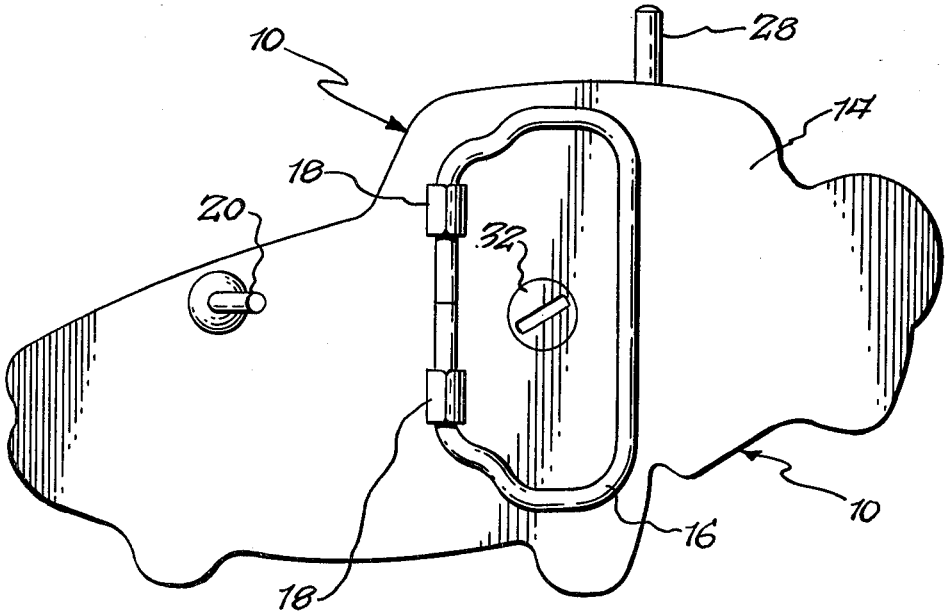
FIG. 2 is an elevational view of the opposite or rear surface of the belt buckle of FIG. 1.

Referring now to FIGS. 1 and 2, the belt buckle according to the present invention comprises a body 10 adapted to be connected to a belt for wearing on a user in a known manner. Body 10 has a front or exposed surface designated 12 which is exposed to view when the belt and buckle are worn on the user. In accordance with the present invention, the structure of body 10 including the shape or configuration of body 10 together with the ornamentation on surface 12 simulates a familiar, known object such as the automobile shown in FIG. 1 and the object simulated is the type having a movable component as will be described. Body 10 has an opposite or rear surface 14 shown in FIG. 2 which faces the body of the user when attached to a belt and worn on the user, so that during use the surface 14 is concealed from the view. A ring or loop element 16 is movably or pivotably connected to surface 14 generally near the center thereof by means of brackets 18, and is adapted for connection to one end of the belt in a conventional manner. A hook element 20 is attached to surface 14 generally near one end of body 10 and is adapted to fit into an eyelet or opening in the other end of the belt in a conventional manner. Other arrangements for connecting the buckle of the present invention to a belt can of course be employed.

In accordance with the present invention, the belt buckle comprises an element carried by body 10 and located so as to be exposed to view when the buckle is worn on the user, and means for connecting the element to the body 10 in a manner permitting movement of the element relative to body 10. The element has a structure which simulates the movable component of the object being simulated. In the belt buckle shown, the aforementioned element is designated 24 and simulates the front hood of the automobile represented. The hood simulating element 24 is movable toward and away from surface 12 and is shown in FIG. 1 at a position during such movement. Although the movable element 24 in the belt buckle shown represents the hood of the simulated automobile, various other movable components of the automobile can be simulated. For example, if the simulated automobile were provided with headlight covers these could be made movable and, in addition, the lights could be turned on when the covers are raised. As a further alternative the elements representing the windshield wipers in the simulated vehicle likewise could be movable. Many other objects and articles in addition to automobiles can of course be simulated.

The belt buckle of the present invention further comprises an operator member generally designated 28 which is carried by body 10 in a manner permitting movement of member 28 in two directions relative to body 10 in response to manual operation of member 28. The belt buckle of the present invention further comprises motion transmission means carried by body 10 and operatively connected to the element 24 and to the operator member 28 for converting movement of the operator member 28 into movement of element 24 in two directions relative to body 10. The means for movably connecting element 24 to body 10 and the motion transmission means both are located within body 10 and now will be described.

In the belt buckle shown, body 10 comprises two mating or complementary portions or sections joined together by a suitable fastener such as screw 32 shown in FIG. 2. One of the body portions thus defines the surface 12 and the other portion defines surface 14. The two body portions define therebetween an interior space or region for housing the connecting means and motion transmission means.

Figure 3:
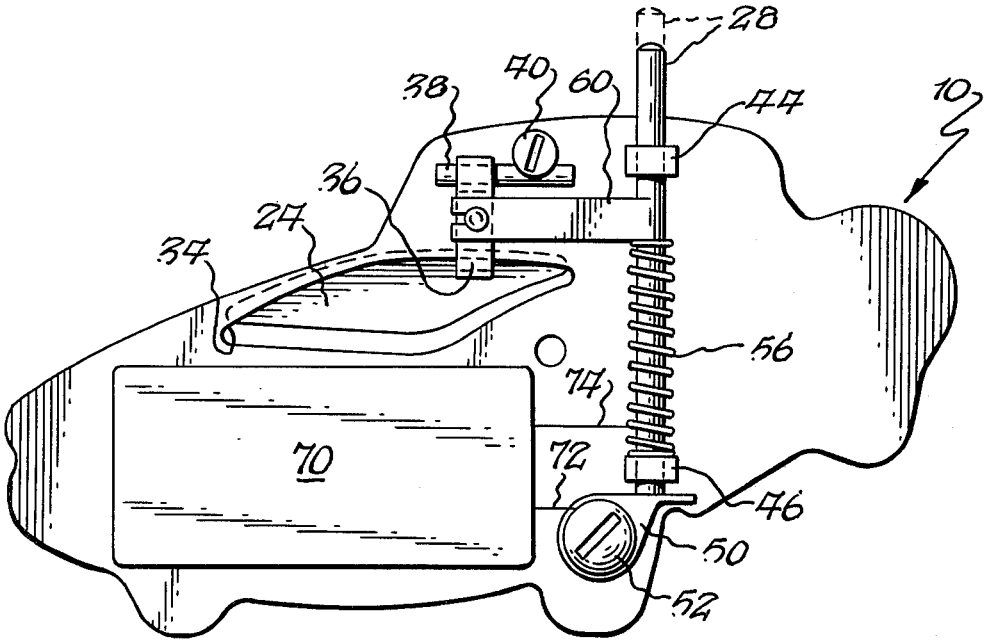
FIG. 3 is an elevational view similar to that of FIG. 2 but with parts removed to show the internal mechanism and sound generating means.

Referring now to FIG. 3, the belt buckle is shown with fastener 32 removed so that the portion of body 10 defining surface 14 is removed thereby exposing to view the internal mechanism and other components which now will be described. The body portion 10 shown in FIG. 3 is provided with an opening 34 of generally irregular rectangular shape which when viewed from the opposite or front side as shown in FIG. 1 simulates the hood opening in the front portion of an automobile. Element 24 which simulates the hood is of corresponding shape and size to as to fit into the opening 24. Element 24 is movably connected to body 10 by means of an arm member 36 fixed at one end to element 24 and pivotably connected to body 10. In particular, arm 36 is in the form of a metal tab attached such as by welding or brazing at one end to the inner surface of element 24. The opposite end of tab 26 is provided with a loop-like formation and a rod or pin member 38 is fixed at one end to body 10 and is received in the loop formation at the end of tab 36. The rod 38 is fixed to body 10 by suitable means, for example the screw fastener designated 40. Pin 38, arm 36, and the attachment to element 24 together with the surface portion of body 10 adjacent these components are so arranged to provide a space or clearance permitting pivotal movement of arm 36 about the pin 38 and corresponding movement of the opposite end portion of arm 36 toward and away from the adjacent portion of body 10. This, in turn, allows movement of element 24 toward and away from body 10 in the manner previously described.

In the belt buckle shown, the operator member 28 is in the form of a rod located such that the major portion of the axial length thereof is within body 10 and the remaining portion extends outwardly of body 10 so as to be accessible for manual operation. Rod 28 is reciprocable along an axis generally parallel to the plane of body 10 and to the plane of the opening 34. In the illustrative belt buckle shown, operator member 28 is disposed generally vertically when the buckle is in place on the user and, furthermore, the end portion exposed for manual operation is located adjacent the upper edge of body 10 when the buckle is worn on the user. As shown in FIG. 3, rod 28 is movably held in two spaced-apart brackets 44 and 46 fixed to the surface of body 10 within the boundary thereof, the brackets being in axial alignment and each provided with an opening through which rod 28 is reciprocable. In FIG. 3, rod 28 is shown in a position where it has been manually depressed so that the inner end of rod 28 is in abutment with a stop member 50 secured to body 10 by a screw fastener 52. This is an operative position of rod 28 as will be described. Rod 28 is urged to an initial or rest position indicated in broken lines in FIGS. 1 and 3 by biasing means in the form of a coil spring 54 located coaxially on rod 28 in a manner such that rod 28 is reciprocable therein. One end of spring 56 abuts the stationary bracket 46. The other axial end of spring 56 abuts a surface of rod 28 in a manner which will be described. When rod 28 is urged by spring 56 into the broken line position shown in FIG. 3, the opposite axial end of rod 28 is out of contact or engagement with the stop element 50.

The motion transmission means for converting movement of operator member or rod 28 into movement of element 24 includes a link member 60 fixed at one end to rod 28 and extending from rod 28 into proximity with the arm member 36. A pin 62 fixed at one end to arm 36 and extending therefrom is movably connected to the end of link 60. In particular, pin 62 is received in a slot or similar opening in the end of link 60. Link 60 can be a separate element fixed such as by welding, brazing or the like to the operator member or rod 28. Alternatively, it can be integrally formed with the rod 28. Accordingly, movement of rod 28 from the broken line to solid line position of FIG. 3 in response to manual operation, i.e. downward movement as viewed in FIG. 3, is converted by the arrangement of link 60, pin 62 and arm 36 pivoted to body 10 into movement of element 24 outwardly and away from body 10. Similarly, when rod 28 is released and then returned by spring 56 to the broken line position illustrated in FIG. 3, element 24 is similarly returned into the initial position in contact with body 10 thereby closing the opening 34. Thus, in response to manual depression and release of member 28 by the wearer of the belt buckle, element 24 is moved first outwardly of and then back toward the front or exposed surface of body 10 thereby simulating opening and closing of the hood of the automobile being simulated by the belt buckle of the present invention. Various other mechanical arrangements can of course be employed for connecting element 24 to body 10 in the manner previously described and for converting the movements of operator member 28 into movements of element 24 as previously described.

The belt buckle of the present invention further includes sound generating means carried by body 10 and operatively connected to operator 28 providing an audible sound output in response to movement of operator member 28 in at least one of the two directions. The sound generating means is generally selected to provide a sound output having some relation to the object being simulated by the belt buckle. Accordingly, the sound generating means for the belt buckle shown in FIGS. 1–3 is selected to provide an audible output sound which simulates engine noise heard during operation of an automobile. Other sounds such as horns or sirens could of course be simulated. Referring to FIG. 3, the sound generating means is generally designated 70 and is of the commercially available, battery operated type adapted to produce output audible output sound in response to completion of an electrical circuit including the battery and sound generator. This, in turn, requires a switch arrangement in the belt buckle, and in the device shown a pair of switch contacts are provided by the metal bracket 46 and the metal stop element 50. Stop 50 is connected by lead 72 to one terminal of sound generating means 70. Contact 46 is connected through the metal spring 56 and metal operator member 28 to lead 74 connected to another terminal of sound generating means 70. The switch further comprises a switch element in the form of the lower end of operator element 28 which is movable into and out of engagement with the contacts to close and open the switch, respectively, in response to movement of the operator member 28 in two directions. In the position shown in solid lines in FIG. 3, the switch is closed, and when the operator element is returned by spring 56 to the initial or broken line position the switch is open.

Thus, in response to manual depression of operator member 28 to close the switch, the sound generating means 70 is energized and emits an audible sound output, and in the arrangement shown this continues for as long as the operator member 28 is held in the solid line position, i.e. the depressed condition shown in FIG. 3. Then, when the operator member 28 is released and is returned by spring 56 the sound output is terminated. Thus, both movement of element 24 outwardly of body 10 and generation of the audible sound output occur simultaneously. As an alternative to electronic sound generation, a suitable battery operated tape recorder could be installed in the belt buckle and which would play in response to manual depression of operator member 28.

Figure 4:
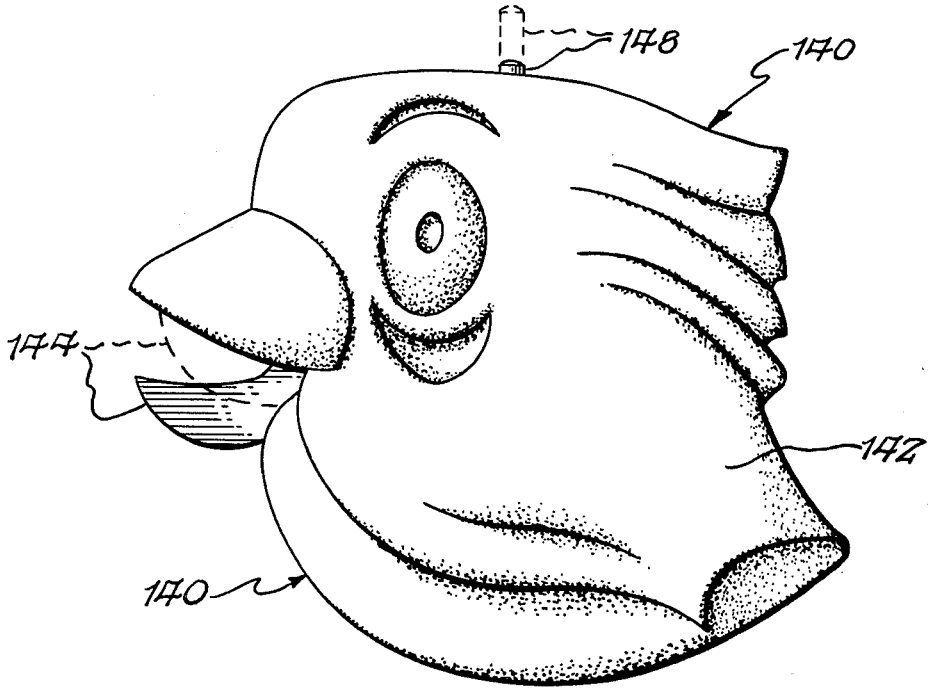
FIG. 4 is an elevational view of the front or exposed surface of a belt buckle according to another embodiment of the present invention.
Figure 5:
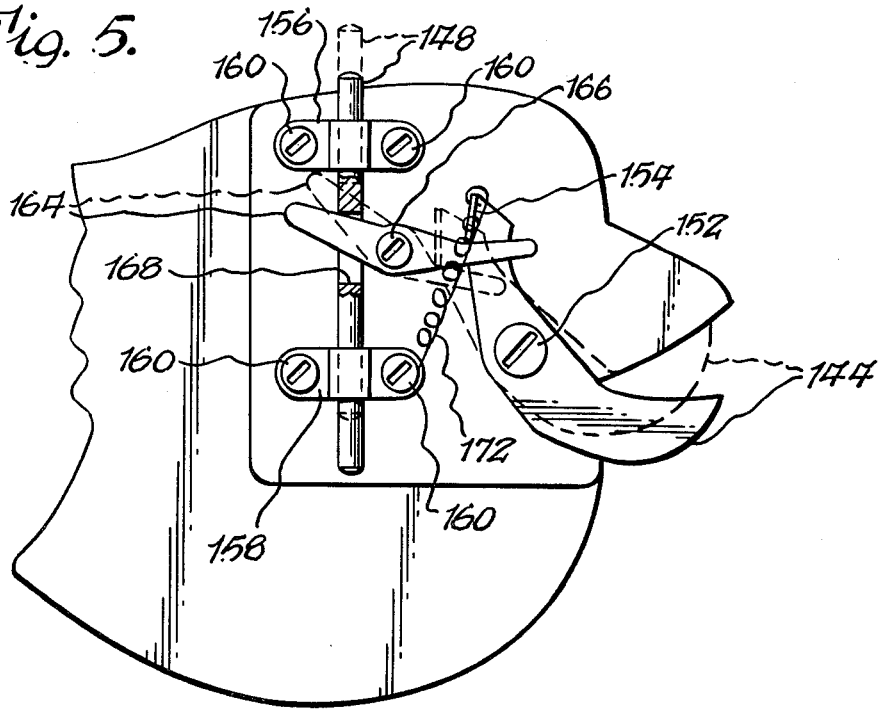
FIG. 5 is an elevational view of the opposite or rear surface of the belt buckle of FIG. 4 with parts removed to show the internal mechanism.

FIGS. 4 and 5 illustrate a belt buckle according to another embodiment of the present invention. The belt buckle comprises a body 140 adapted to be connected to a belt for wearing on a user in the same manner as the buckle shown in FIGS. 1–3. Body 140 has a front or exposed surface designated 142 which is exposed to view when the belt and buckle are worn on the user. Body 140 has a shape or configuration and surface 142 is provided with ornamentation to simulate a bird-like animal. In accordance with the present invention, the belt buckle comprises an element 144 carried by body 140 and located so as to be exposed to view when the buckle is worn on the user, and means for connecting the element 144 to body 140 in a manner permitting movement of element 144 relative to the body 140. Element 144 has a structure simulating a movable component of the object simulated by the belt buckle, and in the belt buckle shown, element 144 simulates the beak or bill of the bird-like animal. The beak simulating element 144 is movable in a plane generally parallel to the plane of the body 140 and/or the front surface 142, and is movable in two directions toward and away from the edge or periphery of surface 142. The belt buckle further comprises an operator member generally designated 148 carried by body 140 in a manner permitting movement of member 148 in two directions relative to body 140 in response to manual operation of member 148. The belt buckle also comprises motion transmission means carried by body 140 and operatively connected to element 144 and to the operator member 148 for converting movement of the operator member into movement of the element 144 in two directions. Thus, manual operation of operator member 148 moves element 144 to simulate opening and closing of the beak of the bird-like animal being simulated. The means for movably connecting element 144 to body 140 and the motion transmission means are located within the body and now will be described.

The body 140 of the belt buckle shown in FIG. 4, like the buckle in FIGS. 1–3, also can comprise two mating or complementary portions or sections joined together in a suitable manner defining therebetween an open space or region for housing the connecting means and motion transmission means. For convenience in illustration, FIG. 5 is a view from the opposite side of body 140 with the other body portion being removed thereby exposing to view the internal mechanism. Element 144 is movably connected to body 140 by suitable means, for example the screw designated 152 extending through element 144 generally at the mid portion thereof and into body 140 whereby element 144 is pivotably connected to body 140. Element 144 is generally elongated and has a beak or bill simulating portion at one end thereof. Element 144 is connected to body 140 in a manner such that this end portion extends beyond the peripheral edge of body 140 in the manner shown. The major portion of element 144 is within the boundary of body 140 and the opposite end portion is provided with an extension 154 disposed at about a right angle to the rest of element 144 and which defines a camming surface for a purpose to be described.

In the belt buckle shown, the operator member 148 is in the form of a rod and is located with the major portion of the axial length thereof within the periphery of body 140 and with the remaining portion extending outwardly of body 140 and accessible for manual operation. Rod 148 is reciprocable along an axis generally parallel to the plane of body 140 and the plane through which element 144 is pivotally movable. In the illustrative buckle shown, operator member 148 is disposed generally vertically when the buckle is in place on the user and, furthermore, the portion of member 148 is exposed for manual operation is located adjacent the upper edge of body 140 when the buckle is worn on the user. As shown in FIG. 5, rod 148 is movably held in two spaced-apart brackets 156 and 158 fixed to the surface of body portion 140 by suitable means such as screw fasteners 160. Each bracket is generally C-shaped with outwardly extending tab portions thereby defining with the surface of 140 two openings through which rod 148 is reciprocable. In FIG. 5, rod 148 is shown in one of two operative positions where it has been manually depressed so that the inner end of rod 148 is at its innermost position within the periphery of body 140.

The motion transmission means for converting movement of operator member 148 into movement of element 144 includes a link member 164 pivotably connected adjacent the midportion or center thereof to body 140 by suitable means such as screw 166. Link member 164 is mounted for pivotable movement in a plane substantially parallel to the plane of movement of element 144. One end of link element 164 is received in an axial slot 168 provided in operator member 148. Slot 168 is of predetermined, relatively short length so that the upper edge of link 164 as viewed in FIG. 5 abuts the downwardly facing axial end face of slot 168. At the other end of line 164, the upper edge of extension 154 of element 144. Element 144 is held or maintained in the closed or broken line position shown in FIGS. 4 and 5 by biasing means in the form of a coil spring 172, one end of which is secured to the inner end of element 144 adjacent extension 154 and the other end of which is secured to body 140, for example to the screw fastener 160 of bracket 158.

Accordingly, movement of operator member 148 from the broken to solid position of FIG. 5 in response to manual operation, i.e. downward movement as viewed in FIGS. 4 and 5, pivots link 164 in a counterclockwise direction about screws 166 urging the camming surface of extension 154 upwardly as viewed in FIG. 5 causing pivotal movement of element 144 in a clockwise direction about an axis of screw 152. Similarly, when operator member 148 is released, spring 174 urges element 144 into the closed or broken position thereby pivoting link 164 in a clockwise direction urging rod 148 upwardly to the initial or broken line position as viewed in FIGS. 4 and 5. Thus, in response to manual depression and release of member 148 by the wearer of the belt buckle, element 144 is moved first away from and then back toward the edge of body thereby simulating opening and closing of the beak of the bird-like animal being simulated by the belt buckle of the present invention. Various other arrangements can of course be employed for connecting element 144 to body 140 in the manner previously described and for converting the movements of operator member 148 into the movements of element 144 as previously described. Also, many other types of animals and animate objects can be simulated, for example large animals such as tigers with simulated movements of the mouths or tails and other birds with simulated movements of the wings.

Figure 6:
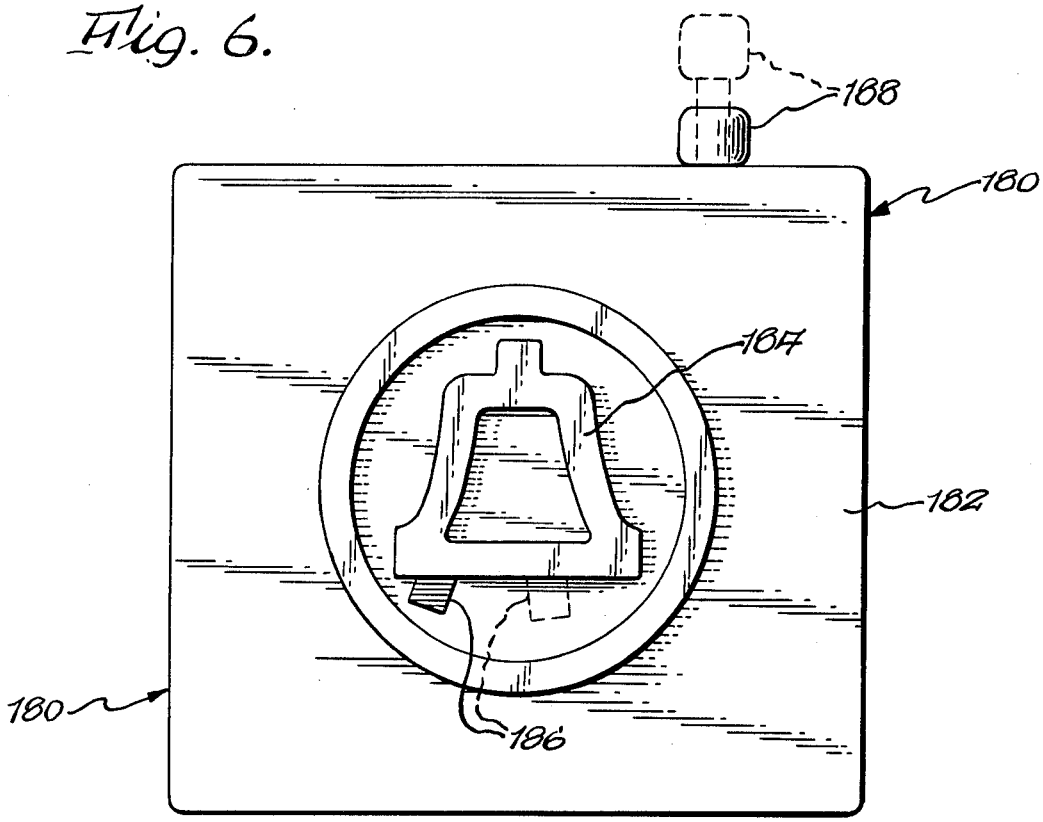
FIG. 6 is an elevational view of the front or exposed surface of a belt buckle according to another embodiment of the present invention.
Figure 7:
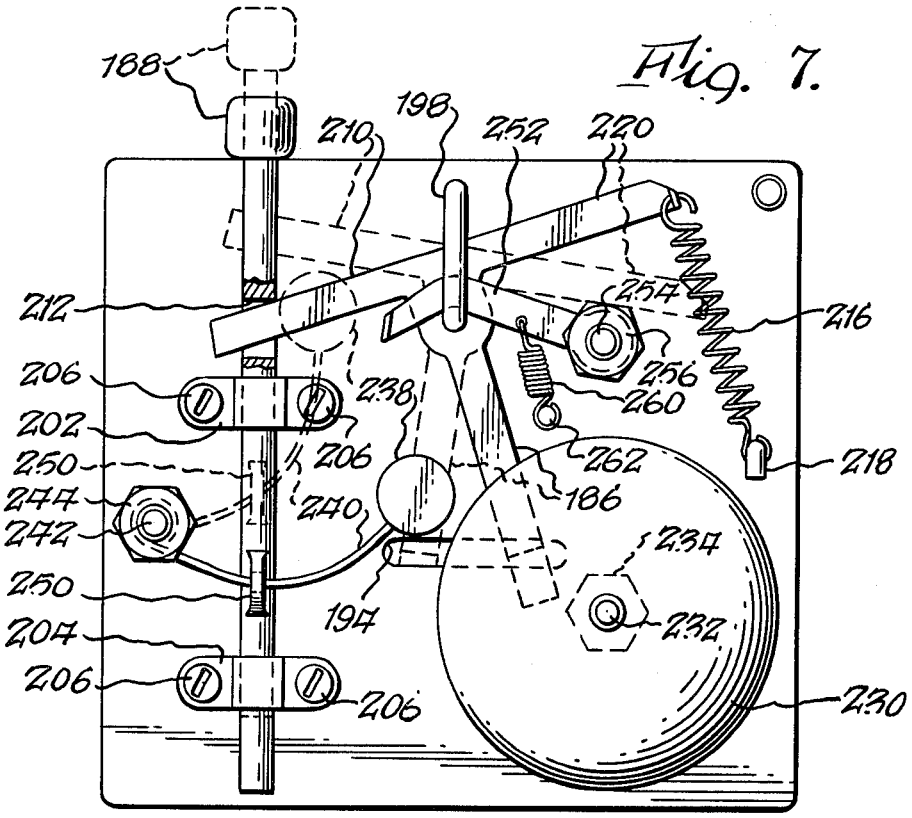
FIG. 7 is an elevational view of the opposite or rear surface of the belt buckle of FIG. 6 with parts removed to show the internal mechanism and sound generating means.

FIGS. 6 and 7 illustrate a belt buckle according to another embodiment of the present invention. The belt buckle comprises a body 180 adapted to be connected to a belt for wearing on a user in the same manner as the buckle as shown in FIGS. 1–5. Body 180 is generally rectangular in shape and has a front or exposed surface 182 which is exposed to view when the belt and buckle are worn on the user. In addition, surface 182 is provided with a raised portion 184 which is shaped and provided with surface ornamentation simulating a bell. In accordance with the present invention, the belt buckle comprises an element 186 carried by body 180 and located so as to be exposed to view when the buckle is worn on the user and means for connecting the element 186 to body 180 in a manner permitting movement of element 186 relative to body 180. Element 186 has a structure simulating a movable component of the bell being represented, and in the belt buckle shown, the element 186 simulates the striker or ringer of the bell. Element 186 has a portion exposed to view extending beyond the edge of raised surface portion 184 and the remainder of element is within body 180 as will be described presently. The element 186 is movable in two directions along a plane substantially parallel to the plane of surface 182 and generally between the sold line and broken line positions illustrated in FIG. 6.

The belt buckle further comprises an operator member generally designated 188 carried by body 180 in a manner permitting movement of member 188 in two directions relative to body 180 in response to manual operation of the member 188. In the belt buckle shown, member 188 is in the form of a rod having an enlargement provided at the outer or exposed end thereof to facilitate manual operation. The belt buckle also comprises motion transmission means carried by body 180 and operatively connected to element 186 and to the operator member 188 into movement of element 186 in the two directions previously described. Thus, manual operation of member 188 moves element 186 to stimulate the ringing of the bell. The means for movably connecting element 186 to body 180 and the motion transmission means are located within body 180 and now will be described.

The body 180 of the belt buckle shown also can comprise two mating or complementary portions or sections joined together in a manner defining therebetween an open space or region for housing the connecting means and motion transmission means. For convenience in illustration, FIG. 7 is a view from the opposite side of body 180 with this other portion being removed thereby exposing to view the internal mechanism and other components. Body 180 is provided with an elongated slot 194 generally centrally thereof and disposed generally parallel to the upper and lower edges of body 180 when the belt buckle is worn during use. Slot 194 is located so that the edge thereof closes the bottom portion of body 180 is substantially coincident with the lower edge of the bell-simulating surface portion 184 as viewed in FIG. 6. Element 186 is located so that the outer end portion thereof extends through slot 194 so as to be exposed to view as shown in FIG. 6. The remainder of element 186 is located within body 180 and terminates adjacent the upper surface thereof. The upper end portion of element 186 as viewed in FIG. 7 is movably connected to body 180 by means of a rod or pin like element 198 whereby element 186 is pivotably mounted to body 180. Element 198 is generally of U-shaped configuration with both ends fixed in body 180 for a purpose which will be described.

In the belt buckle shown, operator member 188 is in the form of a rod located so that the major portion of the axial length thereof is within body 180 and so that the remaining portion extends outwardly of body 180 to be accessible for manual operation. Rod 188 is reciprocable along an axis generally parallel to the plane of body portion 180. In the illustrative buckle shown, operator member 188 is disposed generally vertically when the buckle is in place on the user and the member 188 is movably held in two spaced-apart brackets 202,204 fixed to the surface of body portion 180 within the boundary thereof and in axial alignment. Each bracket is of substantially C-shaped formation with outwardly extending legs fastened to body 180 by screws 206 whereby each bracket defines an opening with the surface of body 180. In FIG. 7, rod 188 is shown in one of two operative positions where it has been manually depressed so that the inner end of rod 188 is at its maximum extend of travel and the enlargement at the opposite end abuts the outer surface of body 180.

The motion transmission means for converting movement of operator member 188 into movement of element 186 includes a link 210 fixed at one end to element 186 and received in a slot 212 in rod 188 in a manner similar to the preceding embodiment. In the mechanism shown, link 210 is elongated and disposed at substantially a right angle to element 186. Preferably link 210 and element 196 can be integrally formed. Element 186 is held or maintained in an initial or rest position by biasing means in the form of a coil spring 216, one end of which is fixed by a screw or similar fastener 218 to body 180 and the opposite end of which is connected to the end of link 220 extending from the junction of link 210 and element 186. Link 220 is disposed at about a right angle to element 186, and links 210 and 220 together with element 186 described a substantially T-shaped member which preferably can be stamped or formed from a single sheet of metal.

Accordingly, movement of rod 188 from the broken to solid position of FIG. 7 in response to manual operation, i.e. downward movement as viewed in FIG. 8, is converted by the arrangement of slot 212 and link 210 into movement of element 186 in a counterclockwise direction. In particular, the downward facing axial end face of slot 212 in rod 188 contacts the upper edge of link 210 and moves the T-shaped member about the axis 198 to move element 186 counterclockwise about pivot axis 198 against the force of spring 216. Similarly, when operator member 188 is released, spring 216 and link 220 return element 186 to the initial position, i.e. pivoting element 186 clockwise about axis 198, and simultaneously link 210 acts on slot 212 in an upward direction to return operator 188 to the initial position. Thus, in response to manual depression and release of member 188 by the wearer of the belt buckle, element 186 is moved first into striking engagement with the simulated bell housing and then back to the rest position thereby simulating ring of the bell being simulated by the belt buckle of the present invention. Various other arrangements can of course be employed for connecting element 186 to body 180 in the manner previously described and for converting the movements of operator member 188 into movements of element 186 as previously described.

The belt buckle of the present invention further includes sound generating means carried by body 180 and operatively connected to operator 188 for providing an audible sound output in response to movement of operator member 188 in at least one of the two directions. As in the embodiment of FIGS. 1–3, the sound generating means is selected to provide a sound output having a relation to the article being simulated, and accordingly the sound generating means for the belt buckle shown in FIGS. 6 and 7 simulates the ringing of a bell. Referring to FIG. 7, the sound generating means comprises a mechanical sound transducer in the form of a bell element generally designated 230 for producing audible output sound in response to mechanical impact, i.e. when struck mechanically. Bell element 220 is generally cup-shaped, of material such as brass or the like adapted to emit a ringing sound when struck mechanically, and is somewhat loosely mounted to body 180 by means of a screw designated 232 and a spacer in the form of nut 234. Bell element 230 is located in the region of the corner of body 180 spaced from links 210,220 and from operator member 188. The sound generating means further comprises a striker member movable into and out of striking engagement with the bell element 230. The striker member includes a metal ball or spherical element 238 connected to one end of a relatively rigid but resilient metal wire 240, the other end of which is connected to body 180 by the combination of screw 242 and nut 244. The striker ball 238 is movable between an initial or rest position indicated in broken lines to a position indicated by the solid lines in striking engagement with the outer surface of bell 230. The sound generating means further comprises motion converting means operatively connected to the operator member 188 and to the striker member 238 for converting movement of the operator member of the operator member into motion of the striker member for striking the bell element 230 to produce an audible output sound. A ring-like formation 250 is fixed to operator rod 188 and wire 240 extends through the formation 250. A dog member 252 is pivotally connected at one end to body 180 by the combination of a screw 254 and nut 256. The dog member 252 is generally elongated but has an angled end portion, and edge of which is received in the loop defined by U-shaped element 198 and the adjacent surface of body 180. Dog member 252 is held in a normal position by means of a coil spring 260, one end of which is connected to the dog 252 and the other end of which is connected to the dog 252 and the other end of which is connected by a screw 262 to body 180.

Upon downward movement of operator element 188 from the initial or broken line position to the solid line position, wire 240 is moved by rod 188 to move striker 238 into engagement with the outer surface of dog 252 until the resiliency of wire 240 is overcome whereupon striker 238 is propelled into striking engagement with bell 230. Upon return movement of operator rod 188, as striker 238 is moved by wire 240 and rod 188 along a return path it lifts dog element 252 out of the way against the force of coil spring 260. The ringing of bell element 230 occurs simultaneously with movement of element 186 into simulated engagement with the bell housing as viewed externally of the buckle.

It is therefore apparent that the present invention accomplishes its intended objects. The belt buckle simulates both the appearance of a known object or article and the movements of a movable component of the object, the movements being simulated in response to manual operation of the buckle by the wearer. In addition the belt buckle generates a sound characteristic of the object being simulated in response to manual operation by the wearer of the buckle. The buckle of the present invention is simple in construction, economical to manufacture and easy and effective in operation.

While several embodiments of the present invention have been described in detail, this is for the purpose of illustration, not limitation.

We claim:

1. A belt buckle comprising:

(a) a body adapted to be connected to a belt for wearing on a user, said body having a structure which simulates a known object having a movable component, said body having means thereon for connecting said body to a belt;

(b) an element carried by said body and located so as to be exposed to view when said buckle is worn on the user, said element having a structure which simulates the movable component of the object;

(c) means for operatively connecting said element to said body in a manner permitting movement of said element relative to said body;

(d) an operator member coupled to said body in a manner permitting movement of said member in two directions relative to said body in response to manual operation, said operator member being located on said body for manual operation when the belt buckle is worn on the user; and (e) motion transmission means carried by said body and operatively connected to said element and to said operator member for converting movement of said operator member into movement of said element in two directions relative to said body while the belt buckle is worn on the user;

(f) whereby manual operation of said operator member by the user causes movement of said element relative to said body for simulating the appearance and activity of the known object while the belt buckle is worn on the user.

2. A belt buckle according to claim 1, wherein said body has a forward facing surface exposed to view when said body is connected to a belt worn on a user and wherein said element is movable toward and away from said surface.

3. A belt buckle according to claim 1, wherein said body has a forward facing surface exposed to view when said body is connected to a belt worn on a user and wherein said element is movable along a plane substantially parallel to the plane of said surface.

4. A belt buckle according to claim 1, further including sound generating means carried by said body and operatively connected to said operator member for providing an audible sound output in response to movement of said operator member in at least one of said two directions.

5. A belt buckle according to claim 4, wherein said sound generating means comprises:

(a) a battery-operated sound generator adapted to produce output audible sound in response to completion of an electrical circuit operatively associated therewith; and (b) a switch connected in said circuit, said switch comprising a pair of contacts connected to said circuit and a switch element connected to said operator member and movable into and out of engagement with said contacts to close and open said switch, respectively, in response to movement of said operator member in two directions.

6. A belt buckle according to claim 4, wherein said sound generating means comprises:

(a) a mechanical sound transducer for producing audible output sound in response to mechanical impact;

(b) a striker member movable into and out of striking engagement with said sound transducer; and (c) motion converting means operatively connected to said operator member and to said striker member for converting movement of said operator member into motion of said striker member for striking said sound transducer to produce audible output sound.

7. A belt buckle according to claim 4, wherein said sound generating means comprises:

(a) a battery-operated sound generator adapted to produce output audible sound in response to completion of an electrical circuit operatively associated therewith; and (b) a switch connected in said circuit, said switch comprising a pair of contacts connected to said circuit and a switch element connected to said operator member and movable into and out of engagement with said contacts to close and open said switch, respectively, in response to movement of said operator member in two directions.

8. A belt buckle comprising:

(a) a body adapted to be connected to a belt for wearing on a user, said body having a structure which simulates a known object having a movable component;

(b) an operator member carried by said body in a maner permitting movement of said member relative to said body in response to manual operation, said operator member being located on said body for manual operation when the belt buckle is worn on the user;

(c) sound generating means carried by said body and operatively connected to said operator member for providing an audible sound output in response to movement of said operator member whereby manual operation of said operator member by the user causes operation of said sound generating means for providing the audible sound output while the belt buckle is worn on the user;

(d) an element carried by said body and located so as to be exposed to view when said buckle is worn on the user, said element having a structure which simulates the movable component of the object;

(e) means for connecting said element to said body in a manner permitting movement of said element relative to said body; and (f) motion transmission means carried by said body and operatively connected to said element and to said operator member for converting movement of said operator member into movement of said element in two directions relative to said body.

9. A belt buckle according to claims 4 or 8 wherein said sound generating means has a structure for providing sound selected to have some relation to the known object being simulated.

10. A belt buckle comprising:

(a) a body adapted to be connected to a belt for wearing on a user;

(b) an operator member coupled to said body in a manner permitting movement of said member relative to said body in response to manual operation, said operator member being located on said body for manual operation when the belt buckle is worn on the user; and (c) sound generating means carried by said body and operatively connected to said operator member for providing an audible sound output in response to movement of said operator member, whereby manual operation of said operator member by the user causes operation of said sound generating means for providing the audible output while the belt buckle is worn on the user;

(d) said sound generating means comprises a mechanical sound transducer for producing audible output sound in response to mechanical input, a striker member movable into and out of striking engagement with said sound transducer, and motion converting means operatively connected to said operator member and to said striker member for converting movement of said operator member into motion of said striker member for striking said sound transducer to produce audible output sound.

* * * * *